US010023984B2

(12) United States Patent
Diethart

(10) Patent No.: US 10,023,984 B2
(45) Date of Patent: Jul. 17, 2018

(54) CLIPPING DEVICE FOR HOLDING A TEXTILE PIECE FOR A WASHING PROCESS AND/OR DRYING PROCESS

(71) Applicant: Franz Josef Diethart, Poellau bei Hartberg (AT)

(72) Inventor: Franz Josef Diethart, Poellau bei Hartberg (AT)

( * ) Notice: Subject to any disclaimer, the term of this patent is extended or adjusted under 35 U.S.C. 154(b) by 96 days.

(21) Appl. No.: 14/418,758

(22) PCT Filed: Aug. 1, 2013

(86) PCT No.: PCT/AT2013/000127
§ 371 (c)(1),
(2) Date: Jan. 30, 2015

(87) PCT Pub. No.: WO2014/019004
PCT Pub. Date: Feb. 6, 2014

(65) Prior Publication Data

US 2015/0167220 A1 Jun. 18, 2015

(30) Foreign Application Priority Data

Aug. 2, 2012 (AT) ..... A 856/2012

(51) Int. Cl.
*D06C 3/08* (2006.01)
*D06F 7/00* (2006.01)
(Continued)

(52) U.S. Cl.
CPC ..... *D06C 3/08* (2013.01); *D06F 7/00* (2013.01); *D06F 17/04* (2013.01); *D06F 18/00* (2013.01);
(Continued)

(58) Field of Classification Search
CPC ... D06C 3/08; D06F 7/00; D06F 18/00; D06F 17/04; D06F 29/005; D06F 35/006; D06F 39/088; D06F 58/12; D06F 73/02
(Continued)

(56) References Cited

U.S. PATENT DOCUMENTS 1,250,420 A * 12/1917 Betker ..... D06F 71/34 122/4 R
2,824,029 A * 2/1958 Zinty ..... C23G 3/00 118/246
(Continued)

FOREIGN PATENT DOCUMENTS

CH 490560 A 5/1970
WO 02052087 A1 7/2002

OTHER PUBLICATIONS

Int'l Search Report dated Mar. 17, 2014 in Int'l Application No. PCT/AT2013/000127.
(Continued)

*Primary Examiner* — Michael E Barr
*Assistant Examiner* — Tinsae B Ayalew
(74) *Attorney, Agent, or Firm* — Panitch Schwarze Belisario & Nadel LLP

(57) ABSTRACT

A device for holding a textile area of a textile piece is provided, for a process of washing and/or drying the textile piece. The device includes at least two opposing clamping surface elements which can be closed by means of a pre-clamping device. The pre-clamping device grips the textile area introduced between the clamping surface elements and extended parallel to the clamping surface, by application of a pre-clamping force between the clamping surface elements. The textile area can be held immovably in the extension surface of the clamping surface relative to the clamping surface elements. The clamping surface elements have a clamping surface with a surface area at least as large
(Continued)

as the textile area. The device includes a nozzle for application of a fluid and/or a washing agent to the textile area for washing the textile area or for application of air to the textile area for smoothing drying.

6 Claims, 7 Drawing Sheets

(51) Int. Cl.

| | |
|---|---|
| ***D06F 58/12*** | (2006.01) |
| ***D06F 73/02*** | (2006.01) |
| ***D06F 17/04*** | (2006.01) |
| ***D06F 18/00*** | (2006.01) |
| ***D06F 39/08*** | (2006.01) |
| ***D06F 29/00*** | (2006.01) |
| ***D06F 35/00*** | (2006.01) |

(52) U.S. Cl.
CPC ..... *D06F 29/005* (2013.01); *D06F 35/006* (2013.01); *D06F 39/088* (2013.01); *D06F 58/12* (2013.01); *D06F 73/02* (2013.01)

(58) Field of Classification Search
USPC ..... 38/102.91; 68/200, 5 A, 235 R
See application file for complete search history.

(56) References Cited

U.S. PATENT DOCUMENTS

| | | | | |
|---|---|---|---|---|
| 4,342,409 | A * | 8/1982 | Brollos | D06F 71/29 223/73 |
| 4,997,000 | A * | 3/1991 | Feast | F06F 18/00 134/102.3 |
| 5,359,786 | A * | 11/1994 | Vierling | D06F 73/02 34/218 |
| 2004/0112095 | A1* | 6/2004 | Bolduan | D06F 17/04 68/5 C |
| 2009/0113944 | A1* | 5/2009 | Kim | D06F 17/00 68/5 C |

OTHER PUBLICATIONS

Office Action dated Nov. 26, 2014 in AT Application No. 856/2012-2.

Response to Written Opinion, dated May 23, 2014, in Int'l Application No. PCT/AT2013/000127.

* cited by examiner

CLIPPING DEVICE FOR HOLDING A TEXTILE PIECE FOR A WASHING PROCESS AND/OR DRYING PROCESS

CROSS-REFERENCE TO RELATED APPLICATIONS

This application is a Section 371 International Application No. PCT/AT2013/000127, filed Aug. 1, 2013, which was published in the German language on Feb. 6, 2014, under International Publication No. WO 2014/019004 A2 and the disclosure of which is incorporated herein by reference.

BACKGROUND OF THE INVENTION

The present invention relates to an clipping device for holding a textile portion of a textile piece for a process of washing the textile piece and a process of drying the textile piece. The clipping device comprises at least two opposite stretching surface elements closable by a biasing device. The biasing device clamps the textile portion introduced between the stretching surface elements and extending in parallel with the stretching surface between the stretching surface elements by application of a biasing force. The textile portion is held, without displacement, in the extension surface of the stretching surface relative to the stretching surface elements.

The invention also comprises a method comprising a process of washing the textile piece and a process of drying the textile piece.

German Patent No. DE 191.9730, and U.S. Pat. Nos. 3,868,835 and 3,664,159 disclose devices for washing of, among other things, non-iron clothes. Since it is not an aim with non-iron clothes to clamp a textile portion by a device part, those documents do not contain any reference thereto.

Furthermore, French Patent Nos. FR 2721625 and FR 2092259 do not disclose any device for clamping a textile portion as part of the washing and drying device.

The device described in European Patent No. EP 2209936 also does not comprise any device parts for clamping a textile portion.

German Patent No. DE10065336 discloses a washing and drying device for textiles, wherein the textiles are brought into a defined position by stretching devices and/or steam dolls for the washing process and/or drying process. The use of stretching devices and steam dolls is space-intensive.

The devices disclosed in German Patent No. DE 2035540 or in U.S. Patent Application Publication No. 2004/0112095 are based on suspending the textiles to be cleaned within the device.

U.S. Pat. No. 5,305,484 and International Patent Application Publication No. WO 2009057177 disclose tensioning means for bringing the textile into a defined shape during a washing and drying process by the device described in U.S. Pat. No. 5,305,484.

International Patent Application Publication Nos. WO 2006134364 and WO 02052087 mention means for receiving the textiles to be cleaned, but no means for clamping the textile portion to be cleaned are explicitly mentioned.

Like the above documents, U.S. Pat. Nos. 3,114,919 and 3,664,159, and WO 0205087 also do not disclose any device for keeping the textile piece in the desired shape by stretching devices during the drying process.

BRIEF SUMMARY OF THE INVENTION

It is an object of the invention discussed herein to provide a method for washing a textile piece in a way that no subsequent clipping of the textile piece is necessary, as well as providing devices required for this purpose. As used in the present disclosure, a textile piece is a textile piece requiring no clipping, wherein the textile piece comprises a textile portion to be defined by a user that is substantially smooth and has no creases or crumples. The invention discussed herein can optionally also comprise the creation of desired pleats within the textile portion. Another object of the invention discussed herein is to provide a device for holding the textile piece during the drying process, the device having an effect similar to applying an iron according to the state of the art.

According to an embodiment of the invention this is achieved by using the clipping device of the present invention during the washing process and/or drying process of the textile piece. The clipping device includes stretching surface elements having e a stretching surface with a surface extension at least as big as the textile portion. The textile portion corresponds to a defined smooth desired area to be produced from the textile piece, and optionally includes a desired pleat. The textile portion is introducible between the stretching surface elements in the shape to be produced. The clipping device includes a nozzle for applying a fluid and/or a detergent to the textile portion to clean the textile portion or for applying air to the textile portion to smoothly dry it.

A textile portion can, for example, be the collar of a shirt, which is defined by its edges and a seam. A textile portion can be a part of a sleeve, part of which is on the one hand defined by the sleeve seam, on the other hand by the half pleat of the sleeve opposite the sleeve seam. Analogous to the latter example, the textile portion can be part of a pair of trousers.

For producing a smooth textile portion, the textile portion is arranged in parallel with the stretching surface elements, after which the clipping device is closed by the biasing device by activating a biasing force, such that the stretching surface elements hold the textile portion in a clamping fashion. The biasing force depends on the size and/or weight, in particular wet weight, of the textile piece, so that the textile portion is supported without displacement, including during the washing process or the drying process. The frictional forces between the textile portion and the stretching surface activated by the biasing force should be chosen to be higher than forces such as the weight of the textile piece, which could cause a displacement of the textile portion. The effect of the stretching device on the textile portion during the drying process corresponds approximately to that of an iron applied to the textile portion.

The textile portion may comprise a desired pleat. For producing a desired pleat via the clipping device, the textile portion is introduced between the stretching surface elements in two layers, wherein the desired pleat to be produced is arranged between the stretching surface elements.

The textile portion is to be introduced into the clipping device in a manner similar to the shape that the textile portion is to have after the washing and/or drying process. The clipping device prevents the textile portion from receiving and assuming a different shape during the washing process and/or drying process.

In some embodiments, the nozzle is coupled to an inlet such that a fluid and/or detergent can be applied to the textile portion for cleaning the textile portion. The inlet extends through a stretching surface element of the clipping device.

The inlet can be coupled to a pumping device for applying the fluid and/or the detergent with overpressure.

In some embodiments, the nozzle is oriented so that the fluid and/or detergent applied to the textile portion, or the jet formed by the fluid and/or detergent and oriented by the nozzle, hits the textile portion at an angle of 90°, so that the fluid and/or detergent can penetrate the fabric of the textile portion. In some embodiments, the nozzle creates a jet from the fluid and/or detergent streaming through the nozzle, so that the fluid/and or detergent can penetrate the fabric of the textile portion.

The nozzle can also comprise means for enriching the fluid and/or detergent with air, in particular oxygen, or other gas mixtures, so that the cleaning effect of the fluid and/or detergent according to the state of the art is increased.

In some embodiments, the nozzle can also be oriented so that the jet formed from the fluid and/or detergent hits the textile portion at an acute angle differing from 90°, in order to optionally remove solid dirt from the textile portion by splitting it off.

The nozzle can be formed so that air is applied to the textile portion through the nozzle for drying the textile portion, which displaces water adhering thereto.

In some embodiments, the clipping device may include a plurality of nozzles, which are distributed over the stretching surface elements.

In some embodiments, the clipping device may include a discharge device for removing the fluid and/or detergent from the textile portion.

The discharge device is coupled to an outlet, which extends through a stretching surface element of the clipping device. The outlet is coupled to a suction device, so that fluid and/or detergent between the stretching surface elements can be exhausted.

In some embodiments, the clipping device may comprise several discharge devices distributed over the stretching surface element.

A nozzle and a suction device may be arranged along an axis as well as offset from the axis in opposite areas of the stretching surface elements.

In one possible embodiment, the nozzle or the discharge device is used as a nozzle during the washing process and as a discharge device during the drying process. The nozzle or discharge device are formed so that on the one hand the fluid and/or detergent can be applied to the textile portion, and on the other hand they can be removed therefrom, wherein the pumping device is controllable to create overpressure or under-pressure, respectively.

The inlet and outlet may be coupled to each other, wherein a pumping device is arranged at the coupling point, which on the one hand creates overpressure in the nozzle area, and on the other hand creates under-pressure in the discharge device area. The fluid and/or detergent applied to the textile portion via the nozzle is discharged from the textile portion as a fluid and/or detergent enriched in dirt through the discharge device arranged at the opposite side of the textile portion. Together with the inlet and the outlet, the nozzle and the discharge device provide a cycle.

The stretching surface may be formed as a surface preventing sliding of the textile portion clamped between the stretching surface elements relative to the clipping device, wherein the stretching surface and the textile portion have a high adhesive friction number and a high sliding friction number when in contact.

Furthermore, another aspect of the invention relates to a method for cleaning and/or drying a textile piece having a textile portion. The textile piece is held by the clipping device according to the above description, wherein the textile piece held by clamping of the textile portion in the clipping device is led through a washing area and optionally a drying area.

According to an aspect of the method of the present invention, the textile portion is brought into a defined shape by introduction into the clipping device, which shape is maintained during the washing process and/or drying process via the clipping device. The defined shape may be a substantially smooth surface, optionally including a desired pleat.

clipping of the textile portion after the washing and/or drying process is omitted.

Via a movement of the clipping device, the textile piece to be cleaned and/or dried is conveyed into a washing unit and/or drying unit.

The washing unit generally comprises a container filled with a fluid and/or detergent, wherein the textile piece is moved relative to the fluid and/or detergent. The latter can be achieved by moving the textile piece through a controlled movement of the clipping device or by moving the fluid and/or detergent. Movement of the fluid and/or detergent may, for example, be achieved via a rotating drum according to the state of the art.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
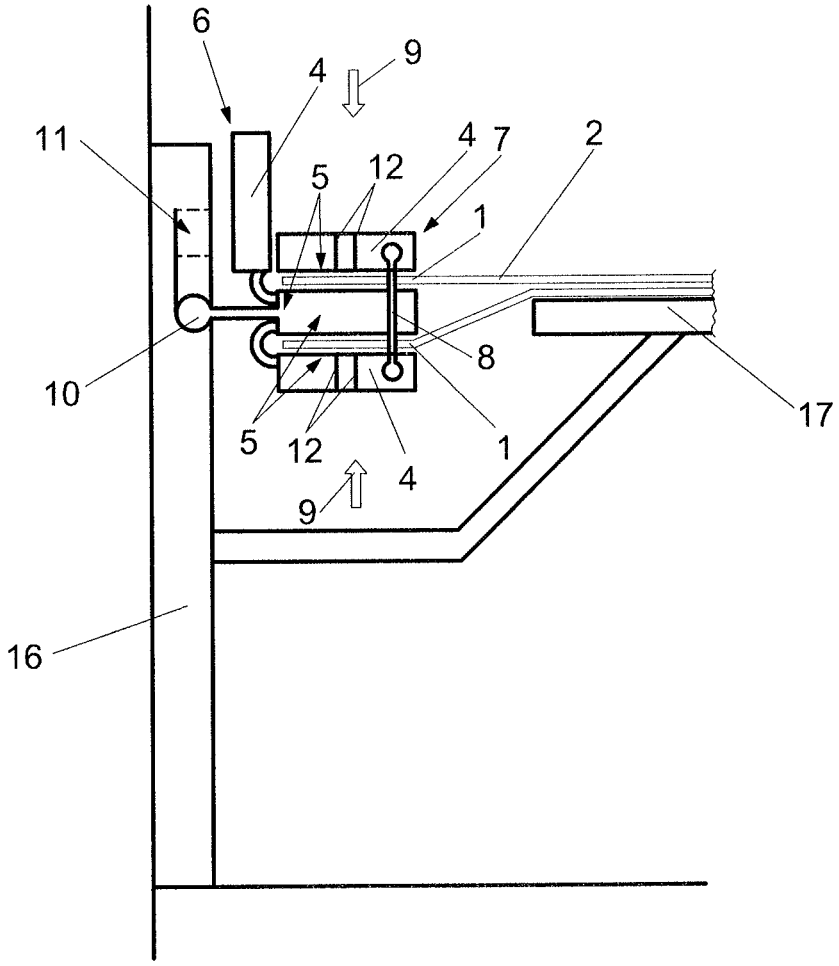
FIG. 1 is a side view of an clipping device, according to a first embodiment of the invention.

FIG. 1 shows a side view of an clipping device according to a first embodiment of the invention, for holding a textile portion 1 of a textile piece 2 for a process of washing the textile piece 2 and/or for a process of drying the textile piece 2. The textile portion 1 corresponds to a defined smooth desired surface to be produced of the textile piece 2, optionally comprising a desired pleat. The clipping device comprises at least two opposite, closable stretching surface elements 4. The stretching surface elements 4 each have a stretching surface 5 with a surface extension at least as big as the textile portion 1. FIG. 1 shows a stretching surface element 4 in an opened position 6. In the opened position 6, a user can easily place the textile portion 1 in the area between the stretching surface elements 4.

After placing the textile portion 1 in the area between the stretching surface elements 4, a stretching surface element 4 is moved from the opened position 6 into a closed position 7. The clipping device comprises a biasing device 8, through which the textile portion 1 introduced between the stretching surface elements 4 and extending parallel to the stretching surface 5 is clamped therebetween, by application of a biasing force 9, and held without displacement relative to the stretching surface elements 4.

The clipping device further comprises at least one nozzle 12 for applying water, air and/or a detergent to the textile portion 1. The nozzle 12 is coupled to an inlet (not shown in FIGS. 1 and 2), wherein the nozzle 12 and the inlet extent in their longitudinal directions through a stretching surface element 4. In the device shown in FIG. 1, the nozzle 12 is oriented so that a jet formed by nozzle 12 consisting of a fluid, detergent and/or air is oriented to the clamped textile portion 1 at an angle of approximately 90°. The nozzle 12 is coupled to a pumping device, not shown in FIG. 1, for creating overpressure.

The clipping device further comprises a discharge device (not shown) for removing the fluid and/or the detergent from the textile portion. The discharge device is coupled to an outlet (not shown), wherein the discharge device and the outlet extend in their longitudinal directions through the stretching surface element 4. The discharge device is coupled to a pumping device (not shown), for creating under-pressure.

The stretching surface 5 is formed as a surface preventing sliding of the textile portion 1 clamped between the stretching surface elements 4, relative to the clipping device. The stretching surface 5 and the textile portion 1 have a high adhesive friction number and a high sliding friction number when in contact and subject to the biasing force 9.

The clipping device further comprises a holding device 10, through which the clipping device is temporarily introduced into a console 11 and held there during the process of introducing the textile portion 1 between the stretching surface elements 4. The holding device 10 is also utilized in a subsequent process for mounting the clipping device in a device for implementing the washing process and/or drying process, so that the clipping device and the textile piece 2 held by the clipping device are movable from, e.g., a washing unit to a drying unit.

The console 11 is part of a placing device shown in FIG. 1, which further comprises a support 16, in which the console 11 is provided, and a table 17, which is only partly shown in FIG. 1. The textile piece 2 is placed on the table 17 to clamp it into the clipping device. For easier use of the clipping device, the table 17 is spaced apart from the support 16.

The console 11 and the support 16 are located outside of the device shown in the other Figs. for implementing the method of the present invention.

Figure 2:
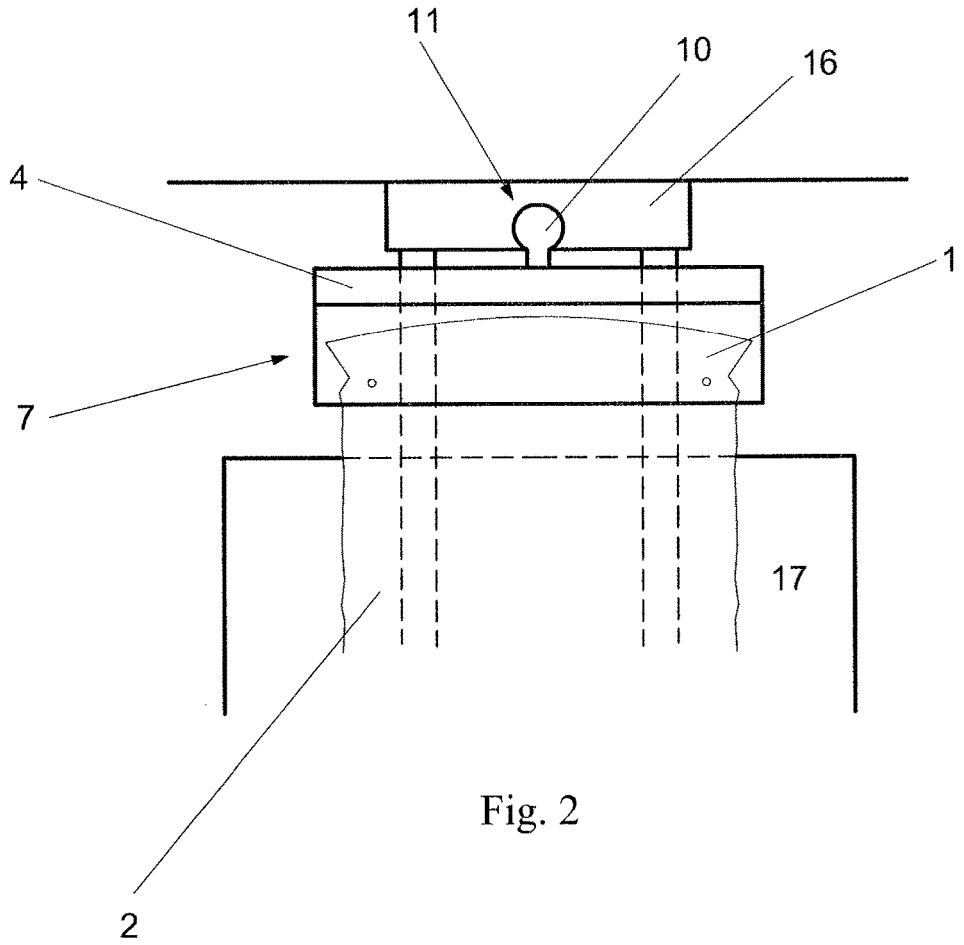
FIG. 2 is a top view of the clipping device of FIG. 1.

FIG. 2 shows a top view of the device illustrated in FIG. 1.

Figure 3:
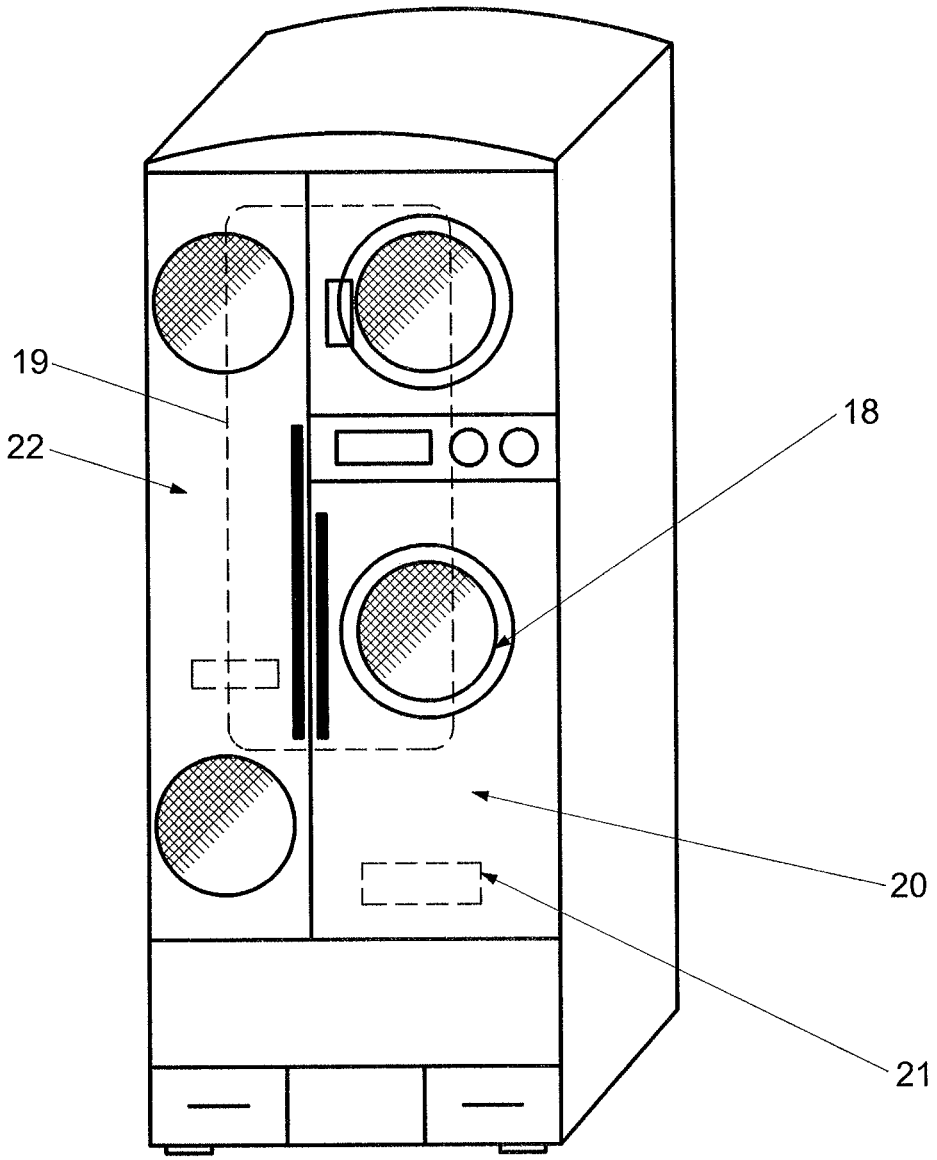
FIG. 3 is a perspective schematic representation of a device for implementing a washing process and/or drying process of a textile piece by using the clipping device of FIG. 1.

FIG. 3 shows a device for implementing a washing process and/or drying process of a textile piece comprising a textile portion clamped into the clipping device.

The textile piece 2 clamped in the clipping device is introduced into the device via a delivery opening 18. The clipping device is mounted to a conveying unit 19 via the holding device 10. The conveying unit 19 moves the clipping device, including the textile piece 2 to be cleaned, to the washing unit 20. Inside the washing unit 20, the textile piece 2 is at least partially moved into a trough 21 filled with a fluid and/or detergent, via a controlled movement of the clipping device. During the washing process, the textile portion 1 clamped by the stretching surface elements 4 is cleaned by the fluid and/or detergent, which are applied to the textile portion 1 through the nozzle 12.

Afterwards, the textile portion 2 is moved into a drying unit 22 via a controlled movement of the clipping device. The drying unit 22 comprises a drying chamber with a height larger than the length of the suspended textile portion 1 to be cleaned. During the drying process, the textile portion 1 clamped by the stretching surface elements 4 is dried by air applied to the textile portion 1 via the discharge device and/or the nozzle 12.

Figure 4:
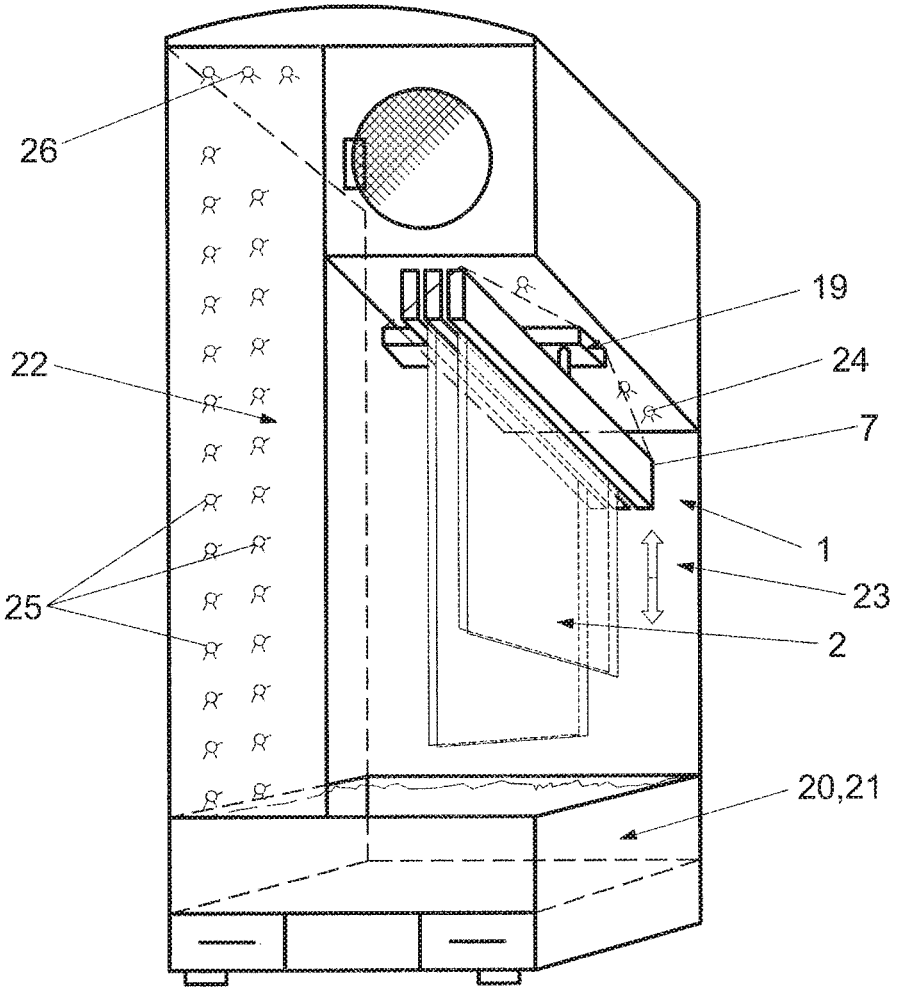
FIG. 4 is an isometric cutaway view of the device of FIG. 3.

FIG. 4 shows a cutaway view of the device illustrated in FIG. 3. For reasons of clarity, the delivery opening 18 is not shown in FIG. 4.

The textile pieces 2 are held by clamping the textile portions 1 in the clipping device. The clipping device is coupled to the conveying unit 19 via the holding device 10.

The textile pieces 2 suspended in FIG. 4 are in a pre-washing unit 23 upstream of the washing unit 20. In the pre-washing unit 23, the textile pieces 2 are sprayed with a fluid and/or a detergent via spraying nozzles 24.

Via the conveying unit 19, the textile pieces 2 are, optionally in combination with the spraying via the spraying nozzles 24 in the pre-washing unit 23, introduced into the washing unit 20. In the washing unit 20, the textile pieces 2 are immersed in a trough 21 and lifted out of the trough 21. This process can be repeated until the textile piece 2 is clean.

The clean textile pieces 2 are then, by a movement of the clipping device, moved into the drying unit 22. Before the partial process of drying the textile pieces 2, the textile piece 2 is sprayed with cold water in the drying unit 22 for rinsing the textile piece 2 according to the state of the art. The cold water is applied to the textile piece 2 through cold-water nozzles 26 arranged in the top area of the drying unit 22.

Drying of the textile piece 2 is achieved by hot-air nozzles 25, from which hot air is applied to the textile piece 2. The hot-air nozzles 25 are arranged in the side areas of the drying unit 22. Drying of the textile piece 2 via hot air is done according to the state of the art.

Finally, the textile piece 2 is moved to the removal opening 27.

Figure 5:
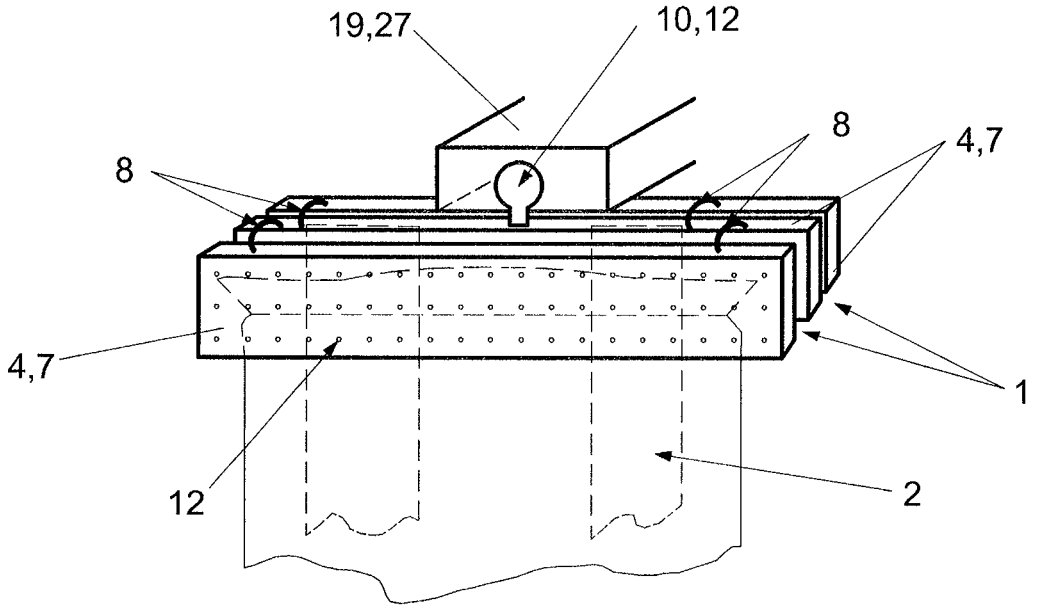
FIG. 5 is a perspective view of an clipping device, according to a second embodiment of the invention.
Figure 6:
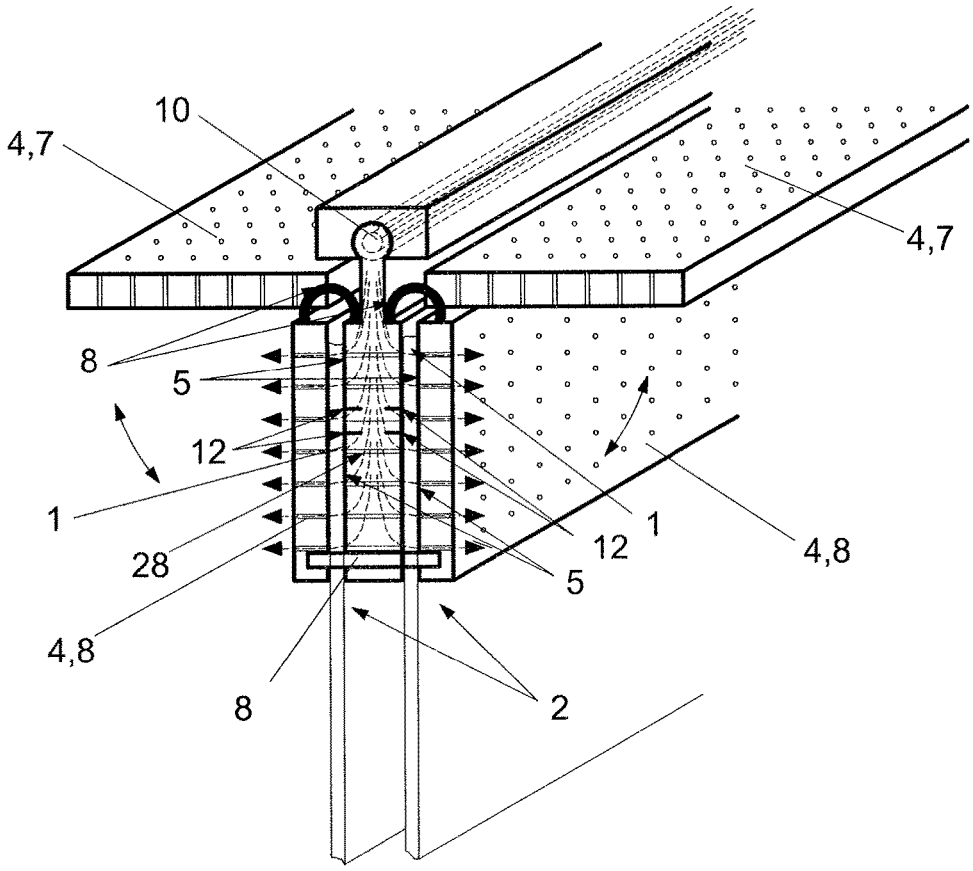
FIG. 6 is a sectional view of the clipping device of FIG. 5.
Figure 7:
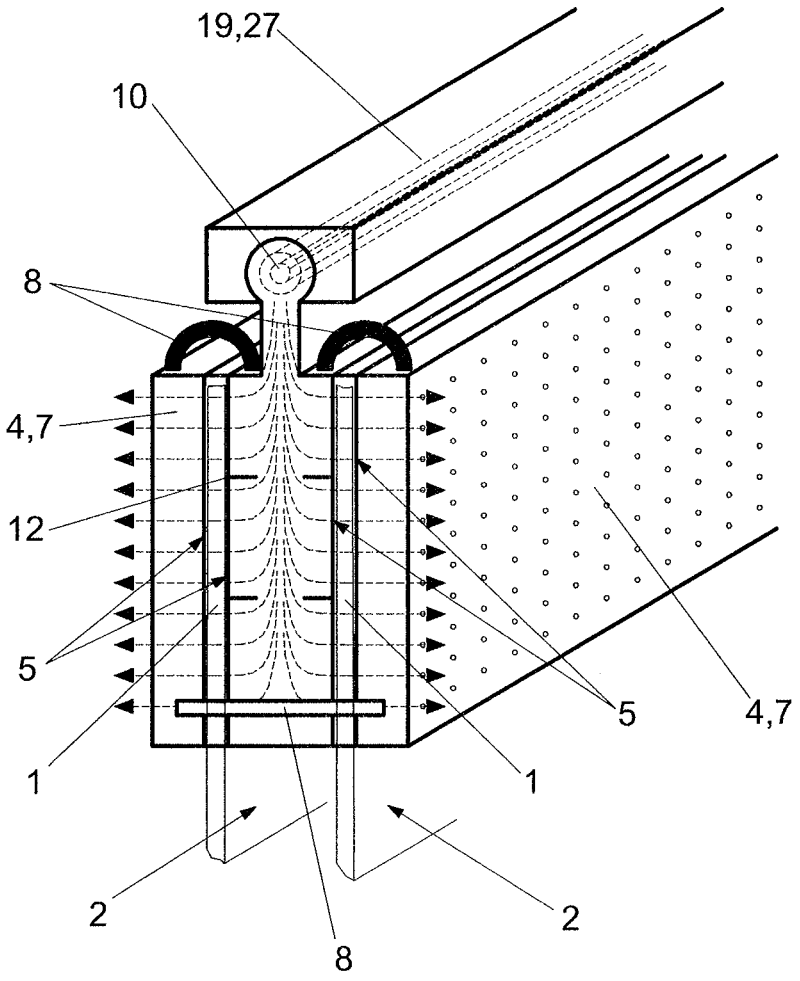
FIG. 7 is a further sectional view of the clipping device of FIG. 5.

FIGS. 5-7 show an clipping device in accordance with a second embodiment. The clipping device comprises three stretching surface elements 4, through which two textile portions 1 of a textile piece 2 are stretched in a clamped manner. For applying the biasing force 9 acting as clamping force, the clipping device comprises a biasing device 8.

In addition, the clipping device comprises a holding device 10, which is engaged with the guiding unit 27 of the conveying unit 19. Via the guiding unit 27, a fluid and/or detergent is introduced into the holding unit 10. Alternatively, the introduced fluid and/or detergent is released into the chamber via the nozzles 12 arranged in the holding device 10, which achieves wetting of the textile piece 2. Alternatively, part of the introduced fluid and/or detergent is also applied directly to the textile portion through the nozzles 12 arranged in the stretching surface elements 4.

FIGS. 6 and 7 show isometric views of the clipping device illustrated in FIG. 5 comprising three stretching surface elements 4, between which two textile portions 1 are stretched in a clamped manner. The three stretching surface elements 4 are connected adjustably to one another via the biasing device 8, wherein the biasing force 9 is also applied through the biasing device 8.

FIG. 6 shows the clipping device with stretching surface elements 4 in an opened position 6 and in a closed position 7. The positions are predefined by the mode of action of the biasing device 8.

FIG. 7 shows the clipping device with stretching surface elements 4 in a closed position 7. A fluid and/or a detergent is introduced into the holding device 10, with a substantially spherical shape, through the guiding unit 27, which is part of the conveying unit 19 and is engaged with the holding device 10.

The central element 4 of the three stretching surface elements 4 comprises a fluid channel 28, which extends from the holding device 10 to nozzles 12 arranged in the two stretching surfaces 5 of the central stretching surface element 4. After exiting the nozzles 12, the fluid and/or detergent contacts the textile portion 1.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A washing and drying device comprising:

a washing unit (20) having a trough filled with at least one of a fluid and a detergent;

a textile piece (2) within the washing unit;

a clipping device for holding a textile portion (1) of the textile piece (2) for a washing and drying process of the textile piece (2), the clipping device comprising:

at least two opposing stretching surface elements (4) each having a stretching surface (5), the stretching surface elements (4) including at least one nozzle, the at least one nozzle being integrated into, and extending through, a respective surface element (4) and having an inlet end at an exterior side of the respective surface element (4) and connected to a pumping device to apply detergent with overpressure and an outlet end at an interior side of the respective surface element (4) to apply the detergent to the textile portion (1) between the surface elements (4) to clean the textile portion and to apply air to smoothly dry the textile portion; and a biasing device for closing the at least two surface elements (4) via a biasing force (9), the textile portion (1) being introduced between the stretching surface elements (4) and extending parallel with the stretching surfaces (5) and the textile portion being clamped between the stretching surface elements (4) by application of the biasing force (9), such that the textile portion (1) is not displaceable in the extension surface of the stretching surface (5) relative to the stretching surface elements (4); and a conveying unit to move the clipping device and the textile piece within the washing unit, and to immerse and lift the textile piece into and out of the trough.

2. The device according to claim 1, wherein each stretching surface (5) has a surface extension at least as big as the textile portion (1); and the textile portion (1) is introduced between the stretching surface elements (4) such that the textile portion (1) corresponds to a desired, defined smooth area in a shape to be produced of the textile piece.

3. The device according to claim 2, further comprising a discharge device for removing the at least one of a fluid and a detergent from the textile portion.

4. The device according to claim 2, wherein the defined area of textile portion to be produced includes a desired pleat.

5. A method for at least one of cleaning and smoothly drying a textile piece having a textile portion held by a clipping device comprising at least two opposing stretching surface elements (4), each having a stretching surface (5) with a surface extension at least as big as the textile portion (1); a biasing device for closing the at least two surface elements (4) via a biasing force (9), and at least one nozzle, the at least one nozzle being integrated into, and extending through, a respective surface element (4) and having an inlet end at an exterior side of the respective surface element (4) and connected to a pumping device to apply detergent with overpressure and an outlet end at an interior side of the respective surface element (4) to apply the detergent to the textile portion (1) between the surface elements (4) to clean the textile portion and to apply air to smoothly dry the textile portion, the method comprising the steps of:

introducing the textile portion between the stretching surface elements, such that the textile portion extends parallel with the stretching surface, applying the biasing force of the biasing device, and, thereby, clamping the textile portion between the stretching surface elements in the clipping device, such that the textile portion is not displaceable in the extension surface of the stretching surfaces relative to the stretching surface elements, mounting the clipping device to a conveying unit of a washing unit, leading the clipping device and the textile piece, via the conveying unit, through a washing area of the washing unit, spraying the textile portion with the detergent via the at least one nozzle, immersing the textile piece at least partially into a trough of the washing unit filled with at least one of a fluid and a detergent, and lifting the textile piece out of the trough.

6. The method according to claim 5, further comprising the step of leading the textile portion through a drying area.

* * * * *